US009703307B2

(12) United States Patent
Yano

(10) Patent No.: US 9,703,307 B2
(45) Date of Patent: Jul. 11, 2017

(54) VOLTAGE DROPPING CIRCUIT AND INTEGRATED CIRCUIT

(71) Applicant: Socionext Inc., Yokohama-shi, Kanagawa (JP)

(72) Inventor: Yuma Yano, Yokohama (JP)

(73) Assignee: SOCIONEXT INC., Yokohama (JP)

( * ) Notice: Subject to any disclaimer, the term of this patent is extended or adjusted under 35 U.S.C. 154(b) by 0 days.

(21) Appl. No.: 14/984,741

(22) Filed: Dec. 30, 2015

(65) Prior Publication Data

US 2016/0224044 A1 Aug. 4, 2016

(30) Foreign Application Priority Data

Jan. 29, 2015 (JP) ..... 2015-016008

(51) Int. Cl.

| | |
|---|---|
| ***G05F 1/10*** | (2006.01) |
| ***G05F 1/656*** | (2006.01) |
| ***G05F 1/56*** | (2006.01) |
| ***G05F 1/618*** | (2006.01) |
| ***G05F 1/613*** | (2006.01) |

(52) U.S. Cl.

CPC ..... *G05F 1/656* (2013.01); *G05F 1/56* (2013.01); *G05F 1/613* (2013.01); *G05F 1/618* (2013.01)

(58) Field of Classification Search

CPC ..... G05F 1/656; G05F 1/618; G05F 1/613; G05F 1/56

See application file for complete search history.

(56) References Cited

U.S. PATENT DOCUMENTS 5,450,025 A * 9/1995 Shay ..... H03K 19/00315 326/81
5,867,381 A * 2/1999 Tzeng ..... H02M 7/219 363/126
5,936,456 A * 8/1999 Naka ..... H03K 19/00315 327/112
6,025,706 A * 2/2000 Takimoto ..... H02M 3/156 323/282
6,404,076 B1 * 6/2002 Matsuda ..... H02M 1/10 307/80

(Continued)

FOREIGN PATENT DOCUMENTS

JP S62-109114 A 5/1987
JP 2004-260052 A 9/2004
JP 2013-025695 A 2/2013

*Primary Examiner* — Thomas J Hiltunen
(74) *Attorney, Agent, or Firm* — Arent Fox LLP

(57) ABSTRACT

A voltage dropping circuit generating a second power source voltage to output to a second node by dropping a first power source voltage supplied to a first node, includes: an output transistor having a first terminal to which the first power source voltage is supplied and a second terminal connected to the second node turns on or off according to a difference between the second power source voltage and a reference voltage; and a back gate variable diode circuit including a diode-connected transistor connected between the first node and the first terminal and to configured to turn on or off according to a voltage difference between the first and second power sources, wherein the first power source voltage is applied to the back gate of the diode-connected transistor when it is higher than the second power source voltage, and the second power source voltage is applied in other case.

5 Claims, 6 Drawing Sheets

(56) References Cited

U.S. PATENT DOCUMENTS

| | | | | |
|---|---|---|---|---|
| 6,566,935 | B1 * | 5/2003 | Renous | G05F 1/59 307/126 |
| 7,489,118 | B2 * | 2/2009 | Fujii | H02M 3/156 323/224 |
| 7,532,062 | B2 * | 5/2009 | Namekawa | H02M 3/073 327/536 |
| 7,719,242 | B2 * | 5/2010 | Negoro | G05F 1/46 323/273 |
| 7,852,059 | B2 * | 12/2010 | Ishii | G05F 1/575 323/222 |
| 8,225,125 | B2 * | 7/2012 | Yu | H03K 17/693 713/300 |
| 8,283,947 | B1 * | 10/2012 | Ubaradka | H03K 19/01852 326/58 |
| 8,446,185 | B2 * | 5/2013 | Nakahara | H03K 17/063 327/108 |
| 8,823,351 | B2 * | 9/2014 | Yamada | H02M 3/156 323/284 |
| 9,329,649 | B2 * | 5/2016 | Gasparini | G06F 1/26 |
| 9,350,241 | B2 * | 5/2016 | Chang | H02M 3/158 |
| 9,584,118 | B1 * | 2/2017 | Dao | H03K 17/6872 |
| 2004/0169237 | A1 * | 9/2004 | Nishikawa | H03K 19/00315 257/401 |
| 2006/0170400 | A1 * | 8/2006 | Pai | H02M 1/10 323/265 |
| 2010/0026253 | A1 * | 2/2010 | Wang | H02M 1/32 323/276 |
| 2012/0280960 | A1 * | 11/2012 | Sheng | G06F 1/266 345/211 |
| 2013/0106174 | A1 * | 5/2013 | Uchida | F02N 11/0866 307/9.1 |
| 2014/0306675 | A1 * | 10/2014 | Kohama | G05F 1/56 323/273 |

* cited by examiner

VOLTAGE DROPPING CIRCUIT AND INTEGRATED CIRCUIT

CROSS-REFERENCE TO RELATED APPLICATION

This application is based upon and claims the benefit of priority of the prior Japanese Patent Application No. 2015-016008, filed on Jan. 29, 2015, the entire contents of which are incorporated herein by reference.

FIELD

The technique disclosed herein relates to a voltage dropping circuit and an integrated circuit.

BACKGROUND

In recent years, a reduction in power consumption of electronic equipment has been desired and the voltage for operating a transistor mounted in an integrated circuit is controlled precisely for each kind of circuit. An integrated circuit has a circuit portion that operates on a base voltage that is supplied from the outside and a circuit portion that operates on a voltage other than the base voltage. The voltage other than the base voltage is generated from the base voltage by using a charge pump circuit or the like, or from the base voltage or a power source voltage that is generated separately by using a low drop out circuit. The power source circuit of the integrated circuit such as this is called an adaptive supply voltage (ASV) system.

Further, in order to reduce the power consumption of an integrated circuit, it is effective to reduce the leak current of a transistor that is mounted in the integrated circuit. As one of method for reducing the leak current of a transistor, an adapting body bias (ABB) system that controls the back gate potential of a transistor is known. The back gate voltage that controls the back gate potential of a transistor is generated by, for example, a low drop out circuit because the current-carrying capacity is small.

In the case where a low drop out circuit that implements the ABB system is provided in an integrated circuit adopting the above-described ASV system, the back gate voltage that is higher than the base voltage is generated from the base voltage whose power source supply capacity is high while the back gate voltage is equal to or less than the base voltage. Specifically, a capacitive element that holds the back gate voltage is charged up to the back gate voltage by the low drop out circuit after being changed up to the base voltage by the base power source. In the low drop out circuit, for example, a transistor is connected between the terminal to which the high-voltage power source voltage is supplied and the terminal from which the back gate voltage is output, and the turning-on/off of the transistor is controlled in accordance with the results of comparison between the back gate voltage and a reference potential.

As described previously, in the power source sequence in the ASV system, the high-voltage power source voltage is generated by the charge pump or the like, and therefore, the supply of the high-voltage power source voltage to each unit within the integrated circuit is delayed from the supply of the base voltage. Consequently, the supply of the high-voltage power source voltage to the low drop out circuit is delayed from the supply of the base voltage. Due to this, in the low drop out circuit, the base voltage is applied to the terminal from which the back gate voltage is output before the high-voltage power source voltage is supplied, and therefore, a current flows backward.

In order to prevent such a backflow of a current in the low drop out circuit, a transistor is diode-connected between the transistor of the low drop out circuit and the supply terminal of the high-voltage power source voltage.

RELATED DOCUMENTS

[Patent Document 1] Japanese Laid Open Patent Publication No. 2004-260052

[Patent Document 2] Japanese Laid Open Patent Publication No. S62-109114

[Patent Document 3] Japanese Laid Open Patent Publication NO. 2013-025695

SUMMARY

According to a first aspect of embodiments, a voltage dropping circuit configured to generate a second power source voltage by dropping a first power source voltage that is supplied to a first node, and to output the second power source voltage to a second node, includes: an output stage transistor, the first power source voltage being configured to be supplied to a first terminal of the output stage transistor, a second terminal of the output stage transistor being connected to the second node, the output stage transistor being configured to turn on or off in accordance with a magnitude relationship between the second power source voltage and a reference voltage; and a back gate variable diode circuit including a diode-connected transistor that is connected between the first node and the first terminal and configured to turn on or off in accordance with a magnitude relationship between the first power source voltage and the second power source voltage, wherein the first power source voltage is applied to the back gate of the diode-connected transistor when the first power source voltage is higher than the second power source voltage, and the second power source voltage is applied to the back gate of the diode-connected transistor when the second power source voltage is higher than the first power source voltage.

According to a second aspect of embodiments, an integrated circuit includes: a first power source circuit configured to generate a first power source voltage from a base voltage that is supplied from the outside; a voltage dropping circuit configured to generate a second power source voltage by dropping the first power source voltage and to output the second power source voltage to a second node; and a logic circuit configured to operate based on the second power source voltage, wherein the second power source voltage is generated from the base voltage when the second power source voltage is lower than the base voltage, and is generated by the voltage dropping circuit after the second power source voltage reaches the base voltage, and the voltage dropping circuit includes: a first node to which the first power source voltage is supplied; an output stage transistor, the first power source voltage being supplied to a first terminal of the output stage transistor, a second terminal of the output stage transistor being connected to the second node, the output stage transistor being configured to turn on or off in accordance with a magnitude relationship between the second power source voltage and a reference voltage; and a back gate variable diode circuit including a diode-connected transistor that is connected between the first node and the first terminal and configured to turn on or off in accordance with a magnitude relationship between the first power source voltage and the second power source voltage, wherein the first power source voltage is applied to the back gate of the diode-connected transistor when the first power source voltage is higher than the second power source voltage, and the second power source voltage is applied to the back, gate of the diode-connected transistor when the second power source voltage is higher than the first power source voltage.

The object and advantages of the embodiments will be realized and attained by means of the elements and combination particularly pointed out in the claims.

It is to be understood that both the foregoing general description and the following detailed description are exemplary and explanatory and are not restrictive of the invention.

DESCRIPTION OF EMBODIMENTS

Before explaining a low drop out circuit and an integrated circuit that makes use of the low drop out circuit of an embodiment, a general integrated circuit adopting the ABB and ASV systems and a low drop out circuit are explained.

Figure 1:
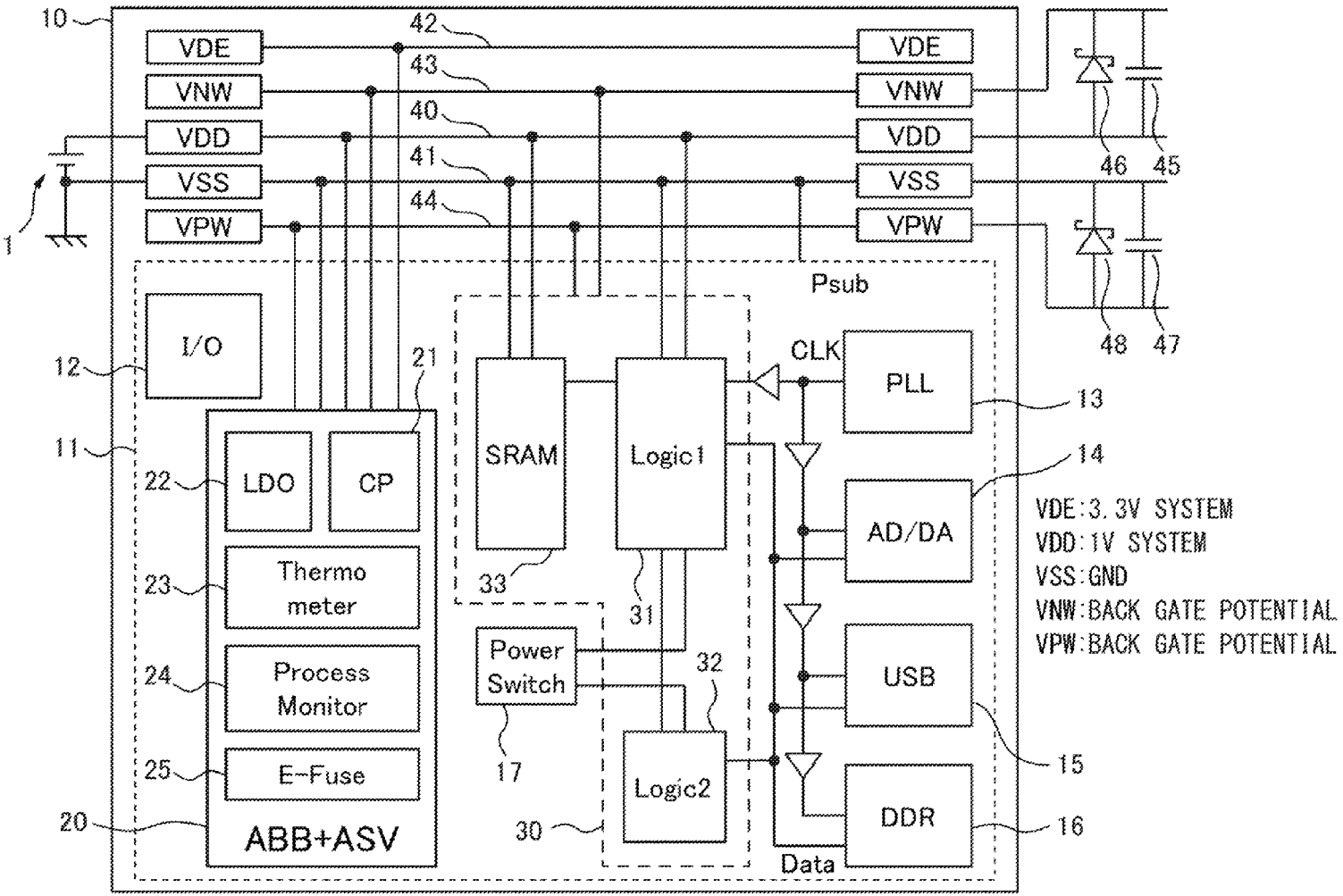
FIG. 1 illustrates a configuration example of a circuit and a power source system within an integrated circuit.

FIG. 1 illustrates a configuration example of a circuit and a power source system within an integrated circuit.

An integrated circuit 10 has a P-type substrate (Psub) 11. On the P-type substrate 11, an I/O circuit 12, a PLL circuit 13, an AD/DA conversion circuit 14, a USB interface circuit 15, a DDR circuit 16, an ABB+ASV circuit unit 20, and a well 30 that forms a logic circuit are formed.

The I/O circuit 12 inputs and outputs data and signals from and to the outside. The PLL circuit 13 generates an operation clock. The AD/DA conversion circuit 14 converts an analog signal into digital data and converts digital data into an analog signal. The USB interface circuit IS interfaces with a USB memory. The DDR (Double Data Rate) circuit 16 inputs and outputs data at high speed to and from an external DRAM board.

The ABB+ASV circuit unit 20 is a power source circuit of the integrated circuit 10 and protects the power source and implements the ABB system and the ASV system. The ABB+ASV circuit unit 20 has a charge pump 21, a low drop out (LDO) 22, a thermometer 23, a process monitor 24, and an electrically programmable fuse element (E-Fuse) 25. The LDO circuit is an example of voltage dropping circuits.

In the well 30, a first logic circuit (Logic1) 31, a second logic circuit (Logic2) 32, and an SRAM 33 are formed. The supply of a base power source voltage to the second logic circuit is controlled by the ASV system by using a power switch 17 provided outside the well 30.

The configuration illustrated in FIG. 1 is an example and is designed appropriately in accordance with specifications.

The integrated circuit having the configuration such as described above has a power source wire through which a power source voltage necessary for the operation of each circuit portion is supplied. In the configuration illustrated in FIG. 1, the integrated circuit has a base power source (VDD) wire 40, a ground (VSS) wire 41, a high-voltage power source (VDE) wire 42, a Pch back gate voltage (VNW) wire 43, and an Nch back gate voltage (VPW) wire 44. To the VDD wire 40 and the VSS wire 41, the base power source (VDD) is supplied from an external power source 1. The external power source 1 is, for example, a IV power source and the VSS wire 41 becomes the GND (0 V) and the VDD wire 40 becomes 1 V. The high-voltage power source (VDE) is, for example, a 3.3V power source and is used for inputting/outputting with already-existing external equipment. The VDE is generated from the VDD power source by the CP 21 and for stabilization of the power source, a capacitive element 45 and a Schottky barrier diode (SBD) 46 are connected in parallel between the VDE wire 43 and the VSS wire 41. There is a case where the capacitive element 45 and the SBD 46 are provided within the integrated circuit 10, but the size is large, and therefore, it is common for them to be attached externally to the integrated circuit 10 as illustrated in FIG. 1. The VNW is a voltage that controls the back gate potential of the Pch transistor by the ABB system and is generated by the LDO 22 from the VDE power source at a voltage between the VDE power source voltage and the VDD power source voltage. The VPW is a voltage that controls the back gate potential of the Nch transistor by the ABB system and is a negative voltage, and is generated from the VDD power source by the CP 21. In the case of the VPW also, for stabilization of the power source, between the VPW wire 44 and the VSS wire 41, an external capacitive element 47 and an SBD 48 are connected in parallel.

The power source wire is formed on the P-type substrate 11, but in FIG. 1, the power source wire is illustrated separate from the P-type substrate 11 for making the power source wire easy-to-see.

The circuit configuration and the power source configuration of the integrated circuit illustrated in FIG. 1 are widely known, and therefore, more explanation is omitted.

Figure 2A:
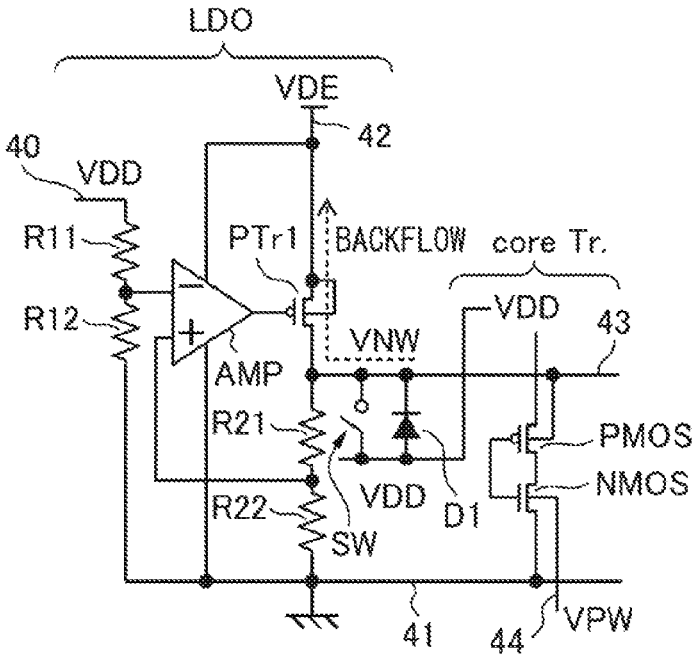
FIG. 2A illustrates a circuit configuration example Of the low drop out (LDO) circuit.
Figure 2B:
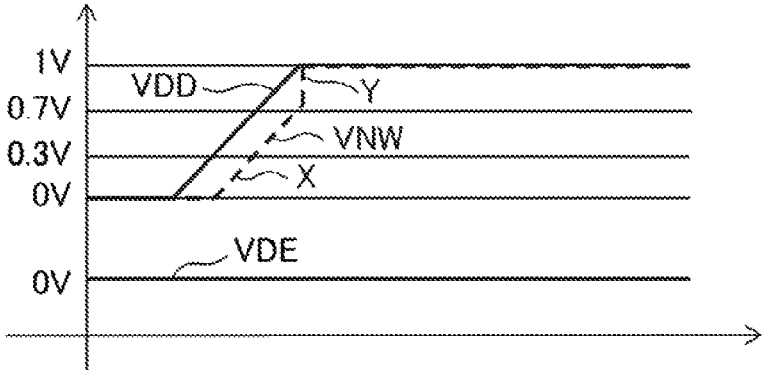
FIG. 2B illustrates a change in the Pch back gate voltage (VNW) due to the power source sequence when starting the power source in the circuit in FIG. 2A.
Figure 2C:
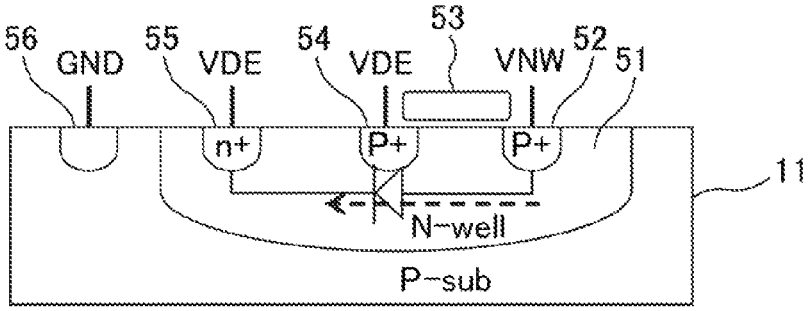
FIG. 2C illustrates a sectional structure of an output stage transistor of the LDO.

FIG. 2A illustrates a circuit configuration example of the low drop out (LDO) circuit. FIG. 2B illustrates a change in the Pch back gate voltage (VNW) due to the power source sequence when starting the power source in the circuit in FIG. 2A. FIG. 2C illustrates a sectional structure of an output stage transistor of the LDO. The LDO circuit is an example of voltage dropping circuits.

The LDO 22 has an output stage transistor PTr1, an amplifier (AMP) that functions as a comparison circuit, a voltage-dividing circuit of the VDD, a voltage-dividing circuit of the VNW, a charging circuit between the VNW and the VDD. In FIG. 2A, as an example of a logic circuit to which the VDD, VSS, VNW, and VPW are supplied, an inverter circuit is also illustrated.

The output stage transistor PTr1 is connected between the VDE wire 42 and the VNW wire 43 and the back gate is connected to the VDE wire 42. Here, the controlled terminal (source) that is connected to the VDE wire 42 of the PTr1 is referred to as a first terminal and the controlled terminal (drain) that is connected to the VNW wire 42 of the PTr1 is referred to as a second terminal. Further, there is a case where the VDE wire 42 that is connected to the PTr1 is referred to as a first node and the VNW wire 43 that is connected to the PTr1 as a second node. Furthermore, there is a case where the VDE (high-voltage power source, voltage) is referred to as a first power source voltage, the VNW (Pch back gate voltage) as a second power source voltage, and the GND (ground) as a third power source voltage.

The voltage-dividing circuit of the VDD has two resistors R11 and R12 connected in series between the VDD wire 40 and the VSS wire 41 and generates a reference voltage by dividing the VDD in a ratio between the resistances of R11 and R12. The voltage-dividing circuit of the VNW has two resistors R21 and R22 connected in series between the VNW wire 43 and the VSS wire 41 and generates the divided voltage VNW by dividing the VNW in a ratio between the resistances of R21 and R22. The AMP compares the reference voltage with the divided voltage VNW and increases the output voltage in the case where the divided voltage VNW is higher than the reference voltage, and reduces the output voltage in the case where the divided voltage VNW is lower than the reference voltage. Due to this, the amount of the current flowing through the PTr1 is reduced in the case where the VNW is higher than a predetermined voltage and the amount of the current flowing through the PTr1 increases in the case where the VNW is lower than the predetermined, voltage, and thereby, the VNW is controlled to be a predetermined voltage.

In the case where the VNW is higher than the VDD and lower than the VDE, if all the charges for charging the capacitive element 45 of the VNW are generated by dropping the VDE when starting the power source, the burden of the CP 21 is too heavy, and therefore, it is necessary to increase the drive force of the CP 21 in order to shorten the time taken for the power source to start. Consequently, when starting the power source, the capacitive element 45 is charged through the VDD power source wire 40 until the VNW reaches the VDD and after the VNW reaches the VDD, the VNW is increased to a predetermined voltage by the LDO 22. Because of this, as illustrated in FIG. 2A, there are provided a diode D1 and a switch SW connected in parallel between the VDD power source wire 40 and the VNW power source wire 43. The diode D1 is connected so that the forward direction is from the VDD toward the VNW. The switch SW is controlled by the VDD and turns on when the VDD reaches about 1 V and turns off when the VNW becomes higher than the VDD.

To the back gate of the PMOS that is formed in the first logic circuit 31 and the second logic circuit 32, the VNW is applied and to the back gate of the NMOS, the VPW is applied, when the values of the VNW and VPW are changed, the power consumption of the PMOS and the NMOS changes.

If the supply of power source from the external power source 1 is started to the integrated circuit 10 at the time of startup, the VDD begins to increase as illustrated in FIG. 2B. When, the VDD reaches about 0.3 V, a current flows through the Schottky barrier diode (SBD) D1, and therefore, the VNW increases along the broken line indicated by X with the state where the voltage is lower than the VDD by about 0.3 V being kept. When the VDD reaches about 1 V, the SW turns on and the VNW reaches a voltage almost the same as the VDD in a brief time as represented by the broken line indicated by Y. The generation of the VDE by the CP 21 delays from the startup by a certain period of time, and therefore, the VDE remains 0 V.

As illustrated in FIG. 2C, the PTr1 is formed in an N well (N-well) 51 formed on the P-sub 11. The PTr1 has a drain electrode 52 and a source electrode 54 in the P+ region on the H well 51, a gate electrode 53 formed right above the N well 51 between the drain electrode 52 and the source electrode 54, and a back gate electrode 55 in the n+ region of the N well 51. The source electrode 54 and the back gate electrode 55 are connected to the VDE wire 42 and the drain electrode 52 is connected to the VNW wire 43. The P-sub 11 is connected to the VSS wire 41 via a region 56 and the voltage is the GND (0 V).

As described above, at the time of starting the power source, in the state where the VDE is 0 V, the VNW becomes the VDD (1 V). When such a state is brought about, as illustrated in FIG. 2C, a diode whose forward direction is from the drain electrode 52 toward the back gate electrode 55 of the PTr1 is formed and a current flows backward from the VNW wire 43 to the VDE wire 42.

Figure 3A:
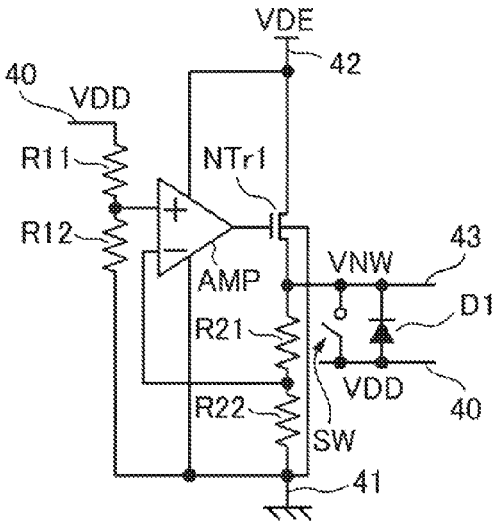
FIG. 3A illustrates a first circuit example of the low drop out circuit (LDO) that prevents the backflow of a current.
Figure 3B:
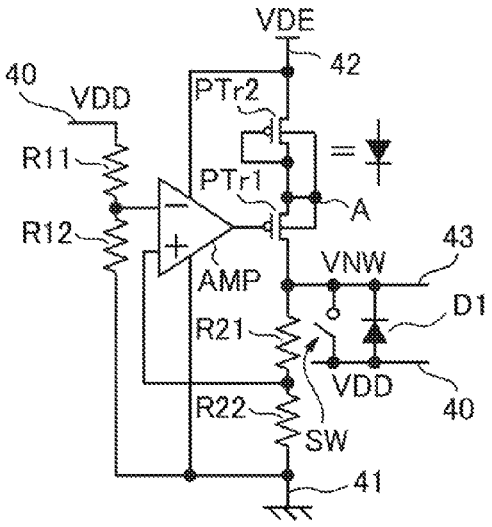
FIG. 3B illustrates a second circuit example of the low drop out circuit (LDO) that prevents the backflow of a current.
Figure 3C:
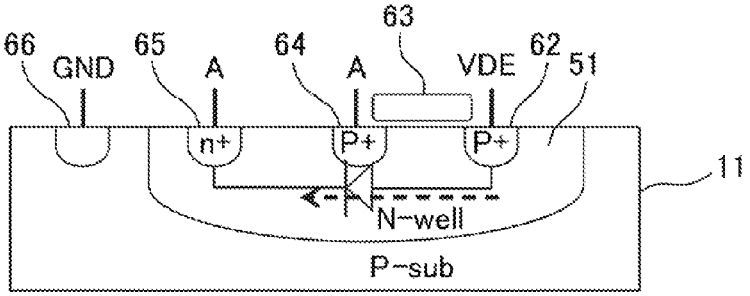
FIG. 3C illustrates a sectional structure of a backflow preventing transistor that is added to the second circuit example.

FIG. 3A illustrates a first circuit example of the low drop out circuit (LDO) that prevents the backflow of a current. FIG. 3B illustrates a second circuit example of the low drop out circuit (LDO) that prevents the backflow of a current. FIG. 3C illustrates a sectional structure of a backflow preventing transistor that is added to the second circuit example.

The LDO in the first circuit, example illustrated in FIG. 3A is a circuit in which the P-channel PTr1 has been replaced with the N-channel PTr1 and the backflow from the VNW wire 43 to the VDE wire 42 is prevented by connecting the back gate to the VSS wire (GND). However, the LDO in FIG. 3A back-biases (about 1 V) the back gate of the output stage transistor, and therefore, the drive force of the output, stage transistor is reduced. Further, by changing the P channel to the N channel, the BSD (Electro-Static Discharge) resistance between the VDE wire 42 and the VNW wire 43 is reduced.

The LDO in the second circuit example illustrated in FIG. 3B is a circuit, in which a P-channel PTr2 has been further connected between the output stage transistor PTr1 and the VDE wire 42. The PTr2 is diode-connected and the back gate is connected to the drain (source of the PTr1). The PTr2 connected like this forms a diode whose forward direction is from the VDE wire 42 toward the source or the PTr1. Due to this, the backflow from the VNW wire 43 to the VDE wire 42 via the PTr1 is prevented. The sectional structure of the PTr2 illustrated in FIG. 3C is the same as that explained in FIG. 2C, and therefore, explanation is omitted.

However, in the LDO in FIG. 3B, the back gate of the PTr2 is forward-biased during the normal operation and as illustrated in FIG. 3C, there is a possibility that an overcurrent will flow through a diode that is formed so that the forward direction is from a source electrode 62 toward a back gate electrode 65 of the PTr2.

In the embodiment that is explained below, a low drop out circuit (LDO) is disclosed, which prevents the backflow of a current, and at the same time, through which an overcurrent does not flow during the normal operation.

Figure 4A:
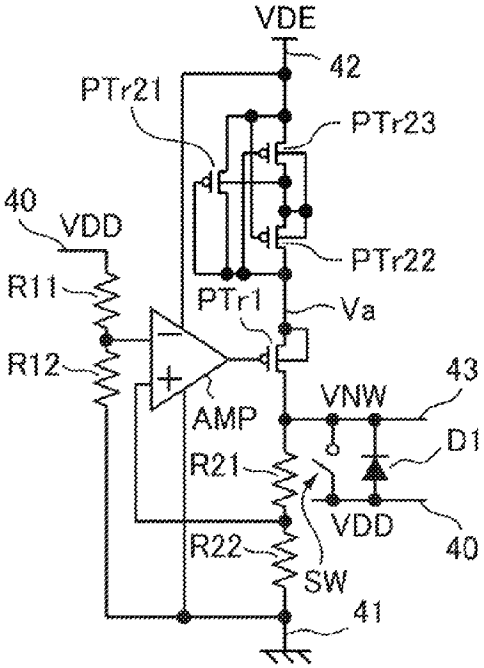
FIG. 4A illustrates a low drop out circuit (LDO) of a first embodiment.
Figure 4B:
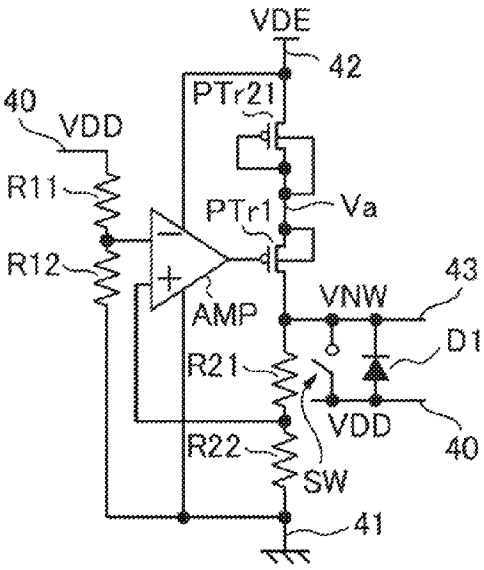
FIG. 4B illustrates an equivalent circuit of the LDO of the first embodiment when VNW>VDE.
Figure 4C:
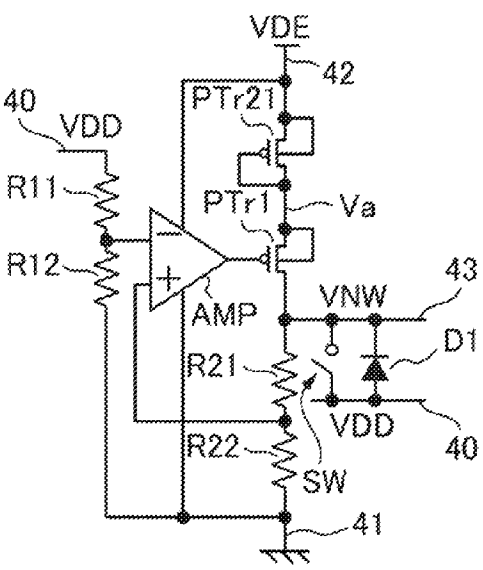
FIG. 4C illustrates an equivalent circuit of the LDO of the first embodiment when VNW<VDE.
Figure 4D:
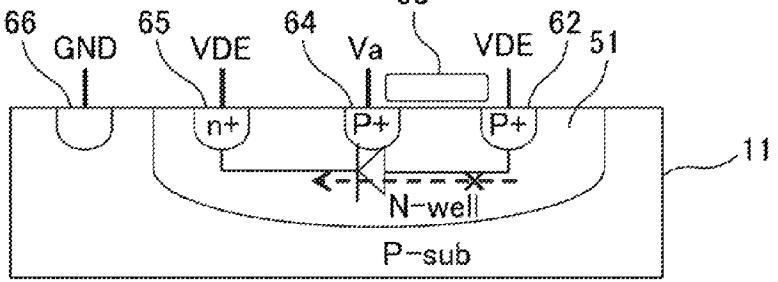
FIG. 4D illustrates a sectional structure of a transistor that forms a back gate variable diode circuit.

FIG. 4A illustrates a low drop out circuit (LDO) of a first embodiment. FIG. 4B illustrates an equivalent circuit of the LDO of the first embodiment when VNW>VDE. FIG. 4C illustrates an equivalent circuit of the LDO of the first embodiment, when VNW<VDE. FIG. 4D illustrates a sectional structure of a transistor that forms a back gate variable diode circuit.

It is possible to use the low drop out circuit (LDO) of the first embodiment as the LDO 22 of the integrated circuit in FIG. 1.

As illustrated in FIG. 4A, the low drop out circuit (LDO) of the first embodiment has a back gate variable diode circuit that is connected between the output stage transistor PTr1 and the VDE wire 42. In other words, the LDO of the first embodiment differs from the LDO illustrated in FIG. 3B in that the back gate variable diode circuit is provided in place of the PTr2.

The LDO of the first embodiment has the output stage transistor PTr1, the AMP, the voltage-dividing circuit of the VDD including R11 and R12, the voltage-dividing circuit of the VNW including R21 and R22, the charging circuit between VNW and VDD including D1 and SW, and the back gate variable diode circuit. The portions other than the back gate variable diode circuit are the same as the elements explained in FIG. 2A to FIG. 3C, and therefore, explanation is omitted.

The back gate variable diode circuit has Pch transistors PTr21, PTr22, and PTr23. The PTr21 is diode-connected between the output stage transistor PTr1 and the VDE wire 42. In other words, the gate of the PTr21 is connected to the drain of the PTr21 (source of PTr1). The PTr22 and PTr23 are connected in series between the PTr1 and the VDE wire 42, and in parallel to the PTr21. The gate of the PTr22 is connected to the VDE wire 42, the gate of the PTr23 is connected to the source of the PTr1, and the back gates of the PTr22 and PTr23 are connected to the connection node of the PTr22 and PTr23. Further, the back gate of the PTr21 is connected to the connection node of the PTr22 and PTr23. Here, the potential of the source of the PTr1 is denoted by Va.

When VNW>VDE, the LDO in FIG. 4A becomes the equivalent circuit illustrated in FIG. 4B. In other words, the back gate variable diode circuit is represented by the PTr21 that is diode-connected and whose back gate is connected to the source of the PTr1. When VNW>VDE, Va>VDE (VNW>Va>VDE) holds, and the PTr22 turns on and the PTr23 turns off. Because of this, the back gate of the PTr21 is connected to the source of the PTr1 and a state where Va is applied is brought about. As explained in FIG. 3B, the PTr21 in FIG. 4B functions as a diode whose forward direction is from the VDE wire 42 toward the PTr1, and therefore, the backflow from the VNW wire 43 to the VDE wire 42, which occurs when VNW>VDE, is prevented.

When VNW<VDE (during normal operation), the LDO in FIG. 4A becomes the equivalent circuit illustrated in FIG. 4C. In other words, the back gate variable diode circuit is represented by the PTr21 that is diode-connected and whose back gate is connected to the VDE wire 42. When VNW<VDE, Va<VDE (VNW<Va<VDE) holds, and the PTr22 turns off and the PTr23 turns on. Because of this, the back gate of the PTr21 is connected to the VDE wire 42 and a state where the VDE is applied is brought about. The PTr21 in this state is in the conduction state and allows a current from the VDE wire 42 to the PTr1 to pass.

The PTr21 in the state in FIG. 4C is in the state where the VDE is applied to the source electrode 62, Va is applied to a gate electrode and a drain electrode 64, and the VDE is applied to the back gate electrode 65 as illustrated in FIG. 4D. Consequently, no forward bias is applied to the back gate and a diode whose forward direction is from the source electrode 62 toward the back gate electrode 65 is not formed, and therefore, it is unlikely that an overcurrent flows.

As explained above, the low drop out circuit (LDO) of the first embodiment prevents the occurrence of an overcurrent when VNW<VDE, as well as preventing a backflow when VNW>VDE.

Figure 5A:
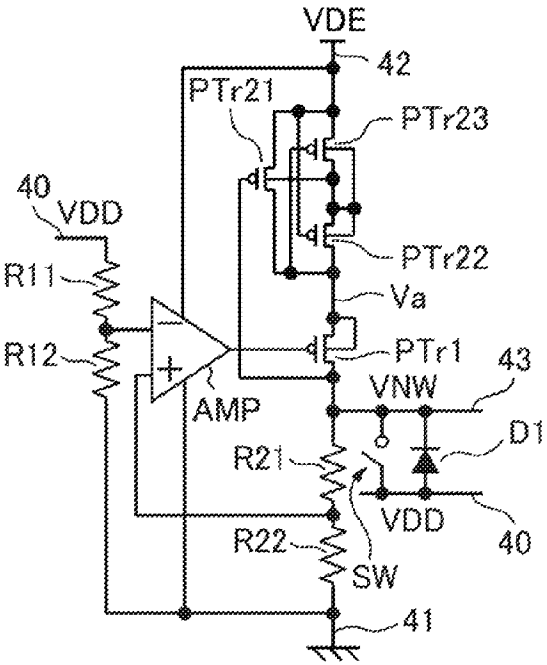
FIG. 5A illustrates a low drop out circuit (LDO) of a second embodiment.
Figure 5B:
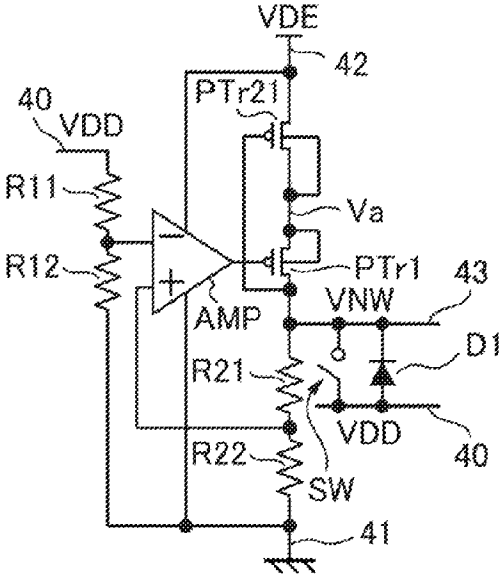
FIG. 5B illustrates an equivalent circuit of the LDO of the second embodiment when VNW>VDE.
Figure 5C:
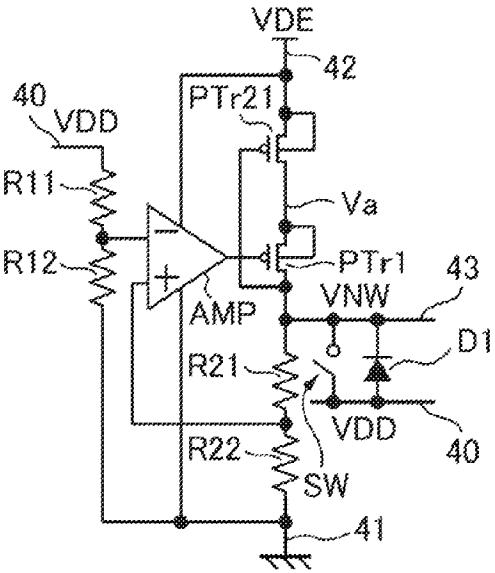
FIG. 5C illustrates an equivalent circuit of the LDO of the second embodiment when VNW<VDE.

FIG. 5A illustrates a low drop out circuit (LDO) of a second embodiment. FIG. 5B illustrates an equivalent circuit of the LDO of the second embodiment when VNW>VDE. FIG. 5C illustrates an equivalent circuit of the LDO of the second embodiment when VNW<VDE.

It is also possible to use the low drop out circuit (LDO) of the second embodiment as the LDO 22 of the integrated circuit in FIG. 1.

The LDO of the second embodiment differs from that of the first embodiment in that the gate of the PTr21 of the back gate variable diode circuit is not connected to the source of the PTr1 but is connected to the drain of the PTr1.

As in the first embodiment, the LDO of the second embodiment becomes the equivalent circuit illustrated in FIG. 5B when VNW>VDE and prevents the backflow from the VNW wire 43 to the VDE wire 42. Further, the LDO of the second embodiment becomes the equivalent circuit illustrated in FIG. 5C when VNW<VDE (during normal operation) and prevents the forward bias of the back gate of the PTr21.

In the first embodiment, when VNW<VDE (during normal operation), a gate-source voltage Vgs of the PTr1 is reduced due to a drain-source voltage Vds of the PTr21, and therefore, the drive force of the LDO is reduced. In contrast to this, in the second embodiment, the gate potential of the PTr21 is connected to the VNW wire 43, which is lower than Va, and therefore, the gate-source voltage Vgs of the PTr21 increases and it is possible to reduce the drain-source voltage Vds of the PTr21. Hereinafter, the principle that the Vds of the PTr21 is reduced is explained.

A drain current Id in the saturation region of a MGS transistor is expressed as $Id=1/2\times W/L\times\mu\times Co\times(Vgs-Vth)^2\times(1+\lambda Vds)$. Here, W is the channel width, L is the channel length, μ is the mobility. Co is a gate oxide film, Vgs is the gate-source voltage, Vth is a threshold value, λ is the channel length modulation coefficient, and Vds is the drain-source voltage.

In the LDO of the first embodiment, it is assumed that the drain current of the PTr21 is denoted as Ids1, the gate-source voltage as Vgs1, and the drain-source voltage as Vds1. Similarly, in the LDO of the second embodiment, it is assumed that the drain current of the PTr21 is denoted as Ids2, the gate-source voltage as Vgs2, and the drain-source voltage as Vds2. Then, if it is supposed that W, L, μ, Co, Vth, and λ are the same in the first and second embodiments, and Ids1=Ids2, then Vgs1<Vgs2, and therefore, Vds1>Vds2 holds.

Consequently, the potential Va of the source of the PTr1 increases, the Vgs of the PTr1 increases, and the drive force of the LDO increases.

As explained above, the low drop out circuit (LDO) of the second embodiment prevents the occurrence of an overcurrent when VNW<VDE, as well as preventing the backflow when VNW>VDE, and the drive force of the output stage transistor PTr1 when VNW<VDE (during normal operation) is high compared to that of the first embodiment.

It is also possible to apply the back gate variable diode circuits explained in the first and second embodiments to a low-drop DC/DC converter.

Figure 6A:
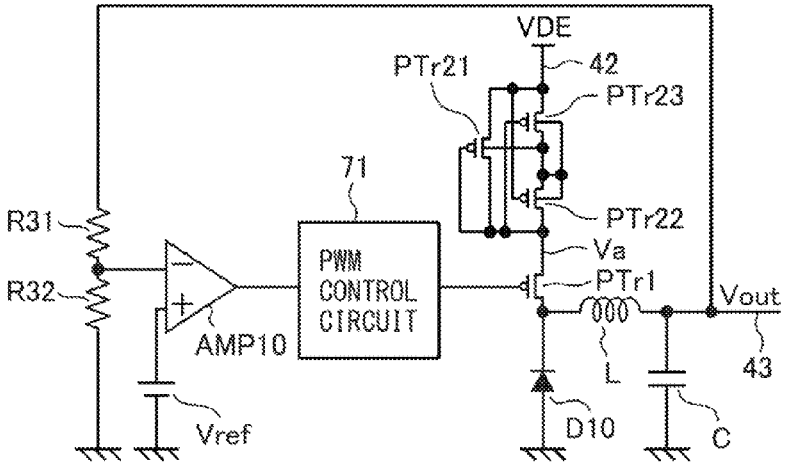
FIG. 6A illustrates a low-drop DC/DC converter of a third embodiment.
Figure 6B:
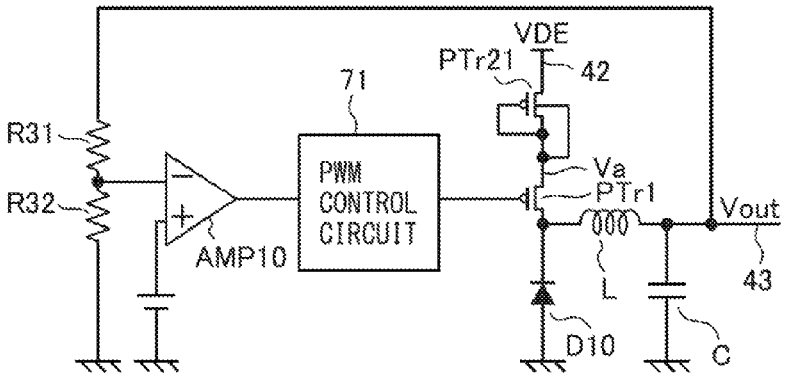
FIG. 6B illustrates an equivalent circuit of the low-drop DC/DC converter of the third embodiment when Vout>VDE.
Figure 6C:
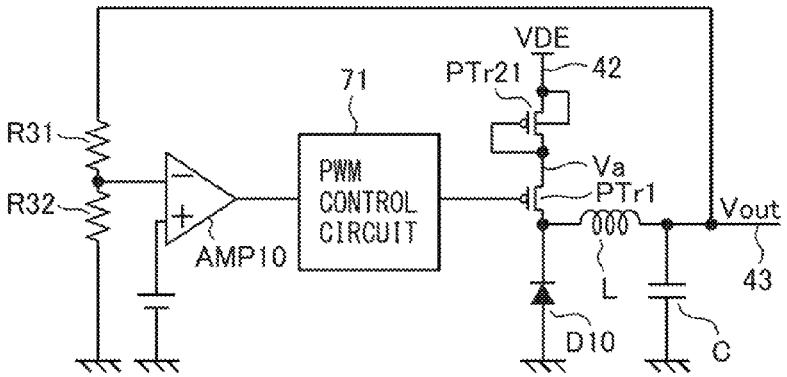
FIG. 6C illustrates an equivalent circuit of the low-drop DC/DC converter of the third embodiment when Vout<VDE.

FIG. 6A illustrates a low-drop DC/DC converter of a third embodiment. FIG. 6B illustrates an equivalent circuit of the low-drop DC/DC converter of the third embodiment when Vout>VDE. FIG. 6C illustrates an equivalent circuit of the low-drop DC/DC converter of the third embodiment when Vout<VDE. The low-drop DC/DC converter is an example of voltage dropping circuits.

The low-drop DC/DC converter of the third embodiment generates an output voltage Vout by dropping the high voltage VDE. The low-drop DC/DC converter has the output stage transistor PTr1, a back gate variable diode circuit, an inductor (coil) L, a capacitive element G, a diode D10, a voltage-dividing circuit, a reference power source Vref, an AMP 10, and a PWM control circuit 71.

The source (first terminal) of the PTr1 is connected to the VDE wire 42 via the back gate variable diode circuit. The back gate variable diode circuit is the same as that of the first embodiment. The gate of the PTr1 is connected to the output of the PWM control circuit 71. The drain (second terminal) of the PTr1 is connected to the VSS wire (GND) via the diode D10. The diode 10 is connected so that the direction from the GND toward the second terminal of the PTr1 is the forward direction. The inductor L is connected to the second terminal of the PTr1 and the second node (VNW wire) 43. The capacitive element C is connected between the second node and the GND. The voltage-dividing circuit has two resistors R31 and R32 connected in series between the second node and the GND. The resistors R31 and R32 output the Vout divided voltage, which is obtained by dividing the output voltage Vout that appears at the second node in a ratio between the resistances of R31 and R32, from the connection node of R31 and R32. The AMP compares the Vout divided voltage with the reference voltage Vref, generates a PWM signal in accordance with the results of the comparison, and applies the PWM signal to the gate of the PTr1. Specifically, in the case where the Vout divided voltage is lower than the reference voltage Vref, the ratio (duty) of the low level of the PWM signal is increased and in the case where the Vout divided voltage is higher than the reference voltage Vref, the ratio (duty) of the low level of the PWM signal is reduced. Due to this, the output voltage Vout is controlled to be a predetermined voltage.

Hereinafter, the operation of the back gate variable diode circuit in the third embodiment is explained.

When Vout>VDE, the back gate variable diode circuit becomes the equivalent circuit illustrated in FIG. 6B. In other words, the back gate variable diode circuit is represented by the PTr21 that is diode-connected and whose back gate is connected to the source of the PTr1. When Vout>VDE, Va>VDE (and Va<Vout) holds, and the PTr22 turns on because the gate potential becomes the VDE and the source potential becomes Va. On the other hand, the PTr23 turns off because the gate potential becomes Va and the source potential becomes the VDE. Because of this, the back gate potential becomes Va (Vout) and the PTr21 turns off, and therefore, the backflow from the second node (VNW 43) to the VDE wire is prevented.

When Vout<VDE (during normal operation), the back gate variable diode circuit becomes the equivalent circuit illustrated in FIG. 6C. In other words, the back gate variable diode circuit is represented by the PTr21 that is diode-connected and whose back gate is connected to the VDE wire 42. When Vout<VDE, Va<VDE (and Va>Vout) holds, and the PTr23 turns on because the gate potential becomes Va and the source potential becomes the VDE. On the other hand, the PTr22 turns off because the gate potential becomes the VDE and the source potential becomes the VDE. Because of this, the PTr21 turns on because the back gate potential becomes the VDE, and at the same time, the forward bias is not applied to the back gate, and therefore, no overcurrent occurs.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a illustrating of the superiority and inferiority of the invention. Although one or more embodiments of the present invention have been described in detail. It should be understood that the various changes, substitutions, and alterations could be made hereto without departing from the spirit and scope of the invention.

What is claimed is:

1. An integrated circuit comprising:

a first power source circuit configured to generate a first power source voltage from a base voltage that is supplied from the outside;

a voltage dropping circuit configured to generate a second power source voltage by dropping the first power source voltage and to output the second power source voltage to a second node; and a logic circuit configured to operate based on a third power source voltage, wherein:

the third power source voltage is generated from the base voltage when the second power source voltage is lower than the base voltage, and is generated from the second power source voltage generated by the voltage dropping circuit after the second power source voltage reaches the base voltage, and the voltage dropping circuit includes:

a first node to which the first power source voltage is supplied;

an output stage transistor, the first power source voltage being supplied to a first terminal of the output stage transistor, a second terminal of the output stage transistor being connected to the second node, the output stage transistor being configured to turn on or off in accordance with a magnitude relationship between the second power source voltage and a reference voltage; and a back gate variable diode circuit including a diode-connected transistor that is connected between the first node and the first terminal and configured to turn on or off in accordance with a magnitude relationship between the first power source voltage and the second power source voltage, wherein, during a normal operation, when the first power source voltage is higher than the second power source voltage, the first power source voltage of the first node is applied to the back gate of the diode-connected transistor, the back gate variable diode circuit turns on and generates a first intermediate voltage that is lower than the first power source voltage at the first terminal, and the output stage transistor generates the second power source voltage by dropping the first power source voltage, and wherein, during a non-normal operation, when the second power source voltage is higher than the first power source voltage, a second intermediate voltage of the first terminal is applied to the back gate of the diode-connected transistor, and the back gate variable diode circuit turns off.

2. The integrated circuit according to claim 1, wherein the back gate variable diode circuit includes:

a first switching transistor that is connected between the first node and the back gate of the diode-connected transistor, the gate of the first switching transistor being connected to the first terminal; and a second switching transistor that is connected between the first terminal and the back gate of the diode-connected transistor, the gate of the second switching transistor being connected to the first node.

3. The integrated circuit according to claim 1, wherein the gate of the diode-connected transistor is connected to the first terminal.

4. The integrated circuit according to claim 1, wherein the gate of the diode-connected transistor is connected to the second terminal.

5. The integrated circuit according to claim 1, comprising:

an inductor connected between the second terminal and the second node;

a diode connected in an opposite direction between the second terminal and a third node to which a third power source voltage that is lower than the first power source voltage is supplied;

a capacitive element connected between the second node and the third node; and a PWM control circuit configured to generate a PWM signal for turning on or off the output stage transistor in accordance with a magnitude relationship between the second power source voltage and the reference voltage.

* * * * *